US008585376B2

(12) United States Patent
Kameya et al.

(10) Patent No.: US 8,585,376 B2
(45) Date of Patent: Nov. 19, 2013

(54) WATER-INJECTION TYPE SCROLL AIR COMPRESSOR

(75) Inventors: Hirotaka Kameya, Rifu (JP); Kazuaki Shiinoki, Yokohama (JP); Natsuki Kawabata, Shizuoka (JP); Hirokatsu Kohsokabe, Omitama (JP)

(73) Assignee: Hitachi Industrial Equipment Systems Co., Ltd., Tokyo (JP)

( * ) Notice: Subject to any disclaimer, the term of this patent is extended or adjusted under 35 U.S.C. 154(b) by 563 days.

(21) Appl. No.: 12/858,453

(22) Filed: Aug. 18, 2010

(65) Prior Publication Data

US 2011/0129362 A1 Jun. 2, 2011

(30) Foreign Application Priority Data

Nov. 30, 2009 (JP) ..... 2009-271257

(51) Int. Cl.
*F01C 21/06* (2006.01)
*F01C 1/02* (2006.01)

(52) U.S. Cl.
USPC ..... 417/410.5; 417/212; 417/228; 418/55.1; 60/39.53

(58) Field of Classification Search
USPC ..... 417/212, 213, 228, 410.5; 60/39.53; 418/55.1–55.6
See application file for complete search history.

(56) References Cited

U.S. PATENT DOCUMENTS 5,640,854 A * 6/1997 Fogt et al. ..... 62/197
5,690,480 A * 11/1997 Suzuki et al. ..... 418/55.2
5,755,564 A * 5/1998 Machida et al. ..... 418/55.2
6,123,529 A * 9/2000 Kawano et al. ..... 418/55.2
6,268,074 B1 * 7/2001 Siepierski et al. ..... 429/416
2008/0089795 A1 4/2008 Takeda et al.
2010/0158733 A1 * 6/2010 Kohsokabe et al. ..... 418/55.6
2010/0287943 A1 * 11/2010 McMahan et al. ..... 60/772

FOREIGN PATENT DOCUMENTS

JP 08-128395 5/1996

OTHER PUBLICATIONS

T Yanagisawa et al., Performance of oil-free scroll-type air compressors, IMechE 1999 C542/088, pp. 279-287, Department of Mechanical Engineering, Shizuoka University, Japan.

* cited by examiner

*Primary Examiner* — Peter J Bertheaud
*Assistant Examiner* — Dominick L Plakkoottam
(74) *Attorney, Agent, or Firm* — Antonelli, Terry, Stout & Kraus, LLP

(57) ABSTRACT

Disclosed is a water-injection type scroll air compressor whose pre-stopping operation time for drying can be reduced while enhancing compressor efficiency.

The compressor body 1 includes a water supply line 24 for supplying water to a water feeder 23 connected to an air suction line 2. The water supply line 24 is provided with a control valve 27 that can control a flow rate of the water. A controller 28 conducts driving control of the control valve 27 in a $5\times10^{-5}$ to $40\times10^{-5}$ range of an injected-water volume ratio (more specifically, a volume ratio between an intake air flow rate and injected-water flow rate in the water feeder 23 of the suction line 2) and at the same time, in an injected-water volume ratio range of the compressor characterized so that an increase rate of overall adiabatic efficiency of the compressor per $1\times10^{-5}$ increase rate of the injected-water volume ratio stays less than 2% of an original or initial value.

12 Claims, 5 Drawing Sheets

WATER-INJECTION TYPE SCROLL AIR COMPRESSOR

BACKGROUND OF THE INVENTION

1. Field of the Invention

The present invention relates generally to scroll air compressors that compress air, and more particularly, to a water-injection type scroll air compressor that entrains water in air.

2. Description of the Related Art

In scroll air compressors, an orbiting scroll member with a nearly spiral wrap formed thereon is mechanically oscillated with respect to a fixed scroll member having a nearly spiral wrap formed thereon to mate with the wrap of the orbiting scroll member, and thus, air is compressed by the oscillation. Known examples of these scroll air compressors include an oil-cooled type that entrains an oil in air, and a water injection type that entrains water in air as described in JP-1996-128395-A (FIG. 10), for example. The oil or water entrained in air creates two actions. One seals the slight clearances between the wrap of the orbiting scroll member and that of the fixed scroll member, these wraps forming a plurality of compression chambers. The other suppresses the widening of the clearances by absorbing compression heat and preventing thermal deformation of members. These actions result in reduction in the amount of air leaking from each compression chamber, and hence, enhancement of compressor efficiency.

Because of their long history of field-proven application, scroll air compressors of the oil-cooled type are excellent in reliability. However, even if the oil included in the compressed air discharged from the compressor body is separated by an oil separator or the like, since the oil is likely to remain, albeit very small in quantity, in the compressed air, the oil-cooled type is unusable in applications that do not permit the presence of even a trace amount of oil, such as food or semiconductor processing. Scroll air compressors of the water-injection type, on the other hand, have been falling behind in proliferation, compared with the oil-cooled type, since the water-injection type requires preventive measures against rust, corrosion or insufficient lubrication, and the like, instead of involving no oil entrainment in compressed air. The market needs in recent years for oil-free clean air, however, are bringing about active development of water-injection type scroll air compressors.

SUMMARY OF THE INVENTION

Water-injection type scroll air compressors are constructed so that they inject water into the suction side or compression chambers of the compressor body in order to improve efficiency. Traditionally, however, no description has been given of an appropriate data range for the amount of water to be injected, nor has a presentation been given of any standards to be established. That is to say, if attention is focused upon efficiency only, injecting a larger amount of water may or will give better results, but at the same time, there are also other considerations.

In general, before the compressor is stopped, dry operation is performed for a while (in further detail, operation with water injection off), for the user wishes to minimize the amount of water left in the compressor body. In addition to discharging the water from the compressor body, the pre-stopping dry operation of the compressor uses compression heat to dry the inside. The dry operation is intended to suppress compressor internal corrosion and water deterioration during the shutdown period, and to facilitate the next start of the compressor. In further detail, the dry operation takes place to suppress the acceleration of galvanic corrosion due to the stationary water sticking to the surface of a metal formed from a plurality of materials, and hence to suppress the acceleration of the internal corrosion which progresses more easily during the shutdown period than during compressor operation. A further purpose is to suppress increases in starting torque due to the fact that if water remains in the compressor body during the start of the compressor, the water will be several thousands times denser than air. A further purpose is to make it less likely for a compressor-starting failure or damage to the compressor body to result from the possible freezing of residual water particularly in cold areas. For these purposes, dry operation of the compressor takes place before it is stopped, and its internal drying during the dry operation can be accomplished more rapidly with a smaller amount of water injection under normal operating conditions. The improvement of efficiency and reduction in the operation time for drying are in a relationship of trade-off, such that it has traditionally been necessary for achieving both at the same time to be considered when determining the amount of water to be injected.

An object of the present invention is to provide a water-injection type scroll air compressor whose pre-stopping operation time for drying can be reduced while enhancing compressor efficiency.

(1) An aspect of the present invention relates to a water-injection type scroll air compressor, which includes: a compressor body that compresses air by mechanically oscillating an orbiting scroll member formed with a nearly spiral wrap thereon, with respect to a fixed scroll member formed with a nearly spiral wrap thereon to mate with the wrap of the orbiting scroll member; and a water supply line for injecting water into a suction side or compression chambers of the compressor body. In the scroll air compressor, the injection through the water supply line is conducted in a $5\times10^{-5}$ to $40\times10^{-5}$ range of an injected-water volume ratio expressed as a volume ratio of an injected-water flow rate to an intake air flow rate, and at the same time, in an injected-water volume ratio range of the compressor characterized so that an increase rate of the compressor's overall adiabatic efficiency per $1\times10^{-5}$ increase rate of the injected-water volume ratio stays less than 2% of an original or initial value.

Experiments by the present inventors indicate that as shown in FIG. 5A, in thermally neutral seasons such as the spring and the fall (in other words, at ordinary air temperature), when the injected-water volume ratio is less than nearly $7\times10^{-5}$, as the injected-water volume ratio increases, the overall adiabatic efficiency of the compressor increases significantly and the resulting increase rate of the overall adiabatic compressor efficiency per $1\times10^{-5}$ increase rate of the injected-water volume ratio reaches 2% or more of the original or initial value. The experiments of the present inventors also indicate that when the injected-water volume ratio is nearly $7\times10^{-5}$, the overall adiabatic efficiency of the compressor is nearly 68%. In addition, the experiments indicate that when the injected-water volume ratio is equal to or more than nearly $7\times10^{-5}$, as the injected-water volume ratio increases, the overall adiabatic efficiency of the compressor increases insignificantly and the resulting increase rate of the overall adiabatic compressor efficiency per $1\times10^{-5}$ increase rate of the injected-water volume ratio decreases below 2%. On the basis of these relationships in characteristics between the injected-water volume ratio and the overall adiabatic efficiency of the compressor, a control range of the injected-water volume ratios in the ordinary-temperature seasons is set to be between, for example, a minimum value of nearly (7 to 12)$\times10^{-5}$ and a maximum value of nearly (18 to 38)$\times10^{-5}$.

Thus, despite a relatively small injected-water volume ratio, the overall adiabatic efficiency of the compressor can be enhanced above nearly 68%, and because of the relatively small injected-water volume ratio, a pre-stopping operation time for drying can be reduced.

It is also assumed that in hot seasons such as the summertime (in other words, at high air temperature), the injected-water volume ratio having the foregoing relationships (characteristics) shifts by nearly (1 to 2)$\times10^{-5}$ in a plus direction. More specifically: at injected-water volume ratios less than nearly $9\times10^{-5}$, the overall adiabatic efficiency of the compressor per $1\times10^{-5}$ increase rate of the injected-water volume ratio reaches 2% or more; at injected-water volume ratios of nearly $9\times10^{-5}$, the overall adiabatic efficiency of the compressor is nearly 68%; and at injected-water volume ratios of at least nearly $9\times10^{-5}$, the overall adiabatic efficiency of the compressor per $1\times10^{-5}$ increase rate of the injected-water volume ratio decreases below 2%. Accordingly, a control range of the injected-water volume ratios in hot seasons is set to be between, for example, a minimum value of nearly (9 to 14)$\times10^{-5}$ and a maximum value of nearly (20 to 40)$\times10^{-5}$. Thus, despite a relatively small injected-water volume ratio, the overall adiabatic efficiency of the compressor can be enhanced above nearly 68%, and because of the relatively small injected-water volume ratio, the pre-stopping operation time for drying can be reduced.

It is further assumed that in cold seasons such as the wintertime (in other words, at low air temperature), the injected-water volume ratio having the foregoing relationships (characteristics) shifts by nearly (1 to 2)$\times10^{-5}$ in a minus direction. More specifically: at injected-water volume ratios less than nearly $5\times10^{-5}$, the overall adiabatic efficiency of the compressor per $1\times10^{-5}$ increase rate of the injected-water volume ratio reaches 2% or more; at injected-water volume ratios of nearly $5\times10^{-5}$, the overall adiabatic efficiency of the compressor is nearly 68%; and at injected-water volume ratios of at least nearly $5\times10^{-5}$, the overall adiabatic efficiency of the compressor per $1\times10^{-5}$ increase rate of the injected-water volume ratio decreases below 2%. Accordingly, a control range of the injected-water volume ratios in cold seasons is set to be between, for example, a minimum value of nearly (5 to 10)$\times10^{-5}$ and a maximum value of nearly (16 to 36)$\times10^{-5}$. Thus, despite a relatively small injected-water volume ratio, the overall adiabatic efficiency of the compressor can be enhanced above nearly 68%, and because of the relatively small injected-water volume ratio, the pre-stopping operation time for drying can be reduced.

Instead of being varied according to season (thermally neutral, hot, or cold) as discussed above, the control range of the injected-water volume ratio may be fixed, irrespective of whether the season is thermally neutral, hot, or cold. An injected-water volume ratio control range with a minimum value of nearly $10\times10^{-5}$ and a maximum value of nearly $20\times10^{-5}$ may be set as a more specific example. Even in this example, as discussed above, the pre-stopping operation time for drying can be reduced while enhancing the overall adiabatic efficiency of the compressor.

(2) Another aspect of the present invention relates to a water-injection type scroll air compressor, which includes: a compressor body that compresses air by mechanically oscillating an orbiting scroll member formed with nearly spiral wraps on both sides thereof, with respect to one pair of fixed scroll members formed with nearly spiral wraps thereon to mate with the wraps of the orbiting scroll member; and a water supply line that injects water into a suction side or compression chambers of the compressor body. In the scroll air compressor, the water supply line conducts the injection in a $5\times10^{-5}$ to $40\times10^{-5}$ range of an injected-water volume ratio expressed as a volume ratio of an injected-water flow rate to an intake air flow rate, and at the same time, in an injected-water volume ratio range of the compressor characterized so that an increase rate of the compressor's overall adiabatic efficiency per $1\times10^{-5}$ increase rate of the injected-water volume ratio stays less than 2% of an original or initial value.

(3) The compressor in above item (1) or (2) is desirably constructed to further include: a control valve provided on the water supply line and adapted to control the flow rate of the water injected into the suction side or compression chambers of the compressor body; a temperature sensor that detects a discharging temperature of the compressor body; means for storage of a target range of the discharging temperature, the target range being preset to stay within the $5\times10^{-5}$ to $40\times10^{-5}$ range of the injected-water volume ratio and at the same time, to stay within an injected-water volume ratio range of the compressor characterized so that the increase rate of the compressor's overall adiabatic efficiency per $1\times10^{-5}$ increase rate of the injected-water volume ratio stays less than 2% of the original or initial value.

In the present invention, conducting appropriate driving control of the control valve so that the discharging temperature detected by the temperature sensor will fall within the preset range allows the control range of the injected-water volume ratio to be changed automatically, irrespective of whether a particular season is hot, thermally neutral, or cold (in further detail, irrespective of environmental impacts of air temperature, relative humidity, atmospheric pressure, and the like).

The above is further detailed below. As shown in FIG. 5B, experiments by the present inventors indicate that similarly to the association in above item (1) between the injected-water volume ratio and the overall adiabatic efficiency of the compressor, association between the injected-water volume ratio and the discharging temperature is held. More specifically, the experimental results in FIG. 5B indicate that in thermally neutral seasons: when the injected-water volume ratio is less than nearly $7\times10^{-5}$, the discharging temperature decreases significantly with increases in the injected-water volume ratio; when the injected-water volume ratio is nearly $7\times10^{-5}$, the discharging temperature is nearly 88° C.; and when the injected-water volume ratio is at least nearly $7\times10^{-5}$, the discharging temperature decreases insignificantly with increases in the injected-water volume ratio. The experimental results also indicate that in thermally neutral seasons; when the injected-water volume ratio is less than nearly $10\times10^{-5}$, the overall adiabatic efficiency of the compressor is nearly 68.5% and the discharging temperature is nearly 87° C.; and when the injected-water volume ratio is nearly $20\times10^{-5}$, the overall adiabatic efficiency of the compressor is nearly 70% and the discharging temperature is nearly 84.5° C. In addition, the experimental results indicate that in hot seasons, since the injected-water volume ratio under the earlier-described characteristics shifts by nearly (1 to 2)$\times10^{-5}$ in the plus direction, for example if the injected-water volume ratio is nearly $12\times10^{-5}$, the overall adiabatic efficiency of the compressor is nearly 68.5% and the discharging temperature is nearly 87° C., and if the injected-water volume ratio is nearly $22\times10^{-5}$, the overall adiabatic efficiency of the compressor is nearly 70% and the discharging temperature is nearly 84.5° C. The experimental results further indicate that in cold seasons, since the injected-water volume ratio under the earlier-described characteristics shifts by nearly (1 to 2)$\times10^{-5}$ in the minus direction, for example if the injected-water volume ratio is nearly $8\times10^{-5}$, the overall adiabatic efficiency of the compressor is nearly 68.5% and the discharging temperature is nearly 87° C., and if the injected-water volume ratio is nearly $18\times10^{-5}$, the overall adiabatic efficiency of the compressor is nearly 70% and the discharging temperature is nearly 84.5° C. Accordingly, setting an upper-limit value of nearly 87° C. and a lower-limit value of nearly 84.5° C., as the target range of the discharging temperature, allows the control range of the injected-water volume ratio to be changed automatically so that the overall adiabatic efficiency of the compressor will range nearly between 68.5% and 70%, irrespective of whether the season is hot, thermally neutral, or cold. In further detail, the injected-water volume ratio can be controlled to range, in thermally neutral seasons, between a minimum value of nearly $10\times10^{-5}$ and a maximum value of nearly $20\times10^{-5}$, in hot seasons, between a minimum value of nearly $12\times10^{-5}$ and a maximum value of nearly $22\times10^{-5}$, and in cold seasons, between a minimum value of nearly $8\times10^{-5}$ and a maximum value of nearly $18\times10^{-5}$.

(4) The control means in above item (3) desirably increases an opening degree of the control valve when the temperature sensor detects a discharging temperature exceeding the upper-limit value of the discharging temperature target range stored in the storage means, and reduces the opening degree of the control valve when the temperature sensor detects a discharging temperature less than the lower-limit value of the discharging temperature target range stored in the storage means.

While enhancing the efficiency of the compressor, the present invention reduces the pre-stopping operation time for drying.

DESCRIPTION OF THE PREFERRED EMBODIMENTS

Hereunder, an embodiment of the present invention will be described referring to the accompanying drawings.

Figure 1:
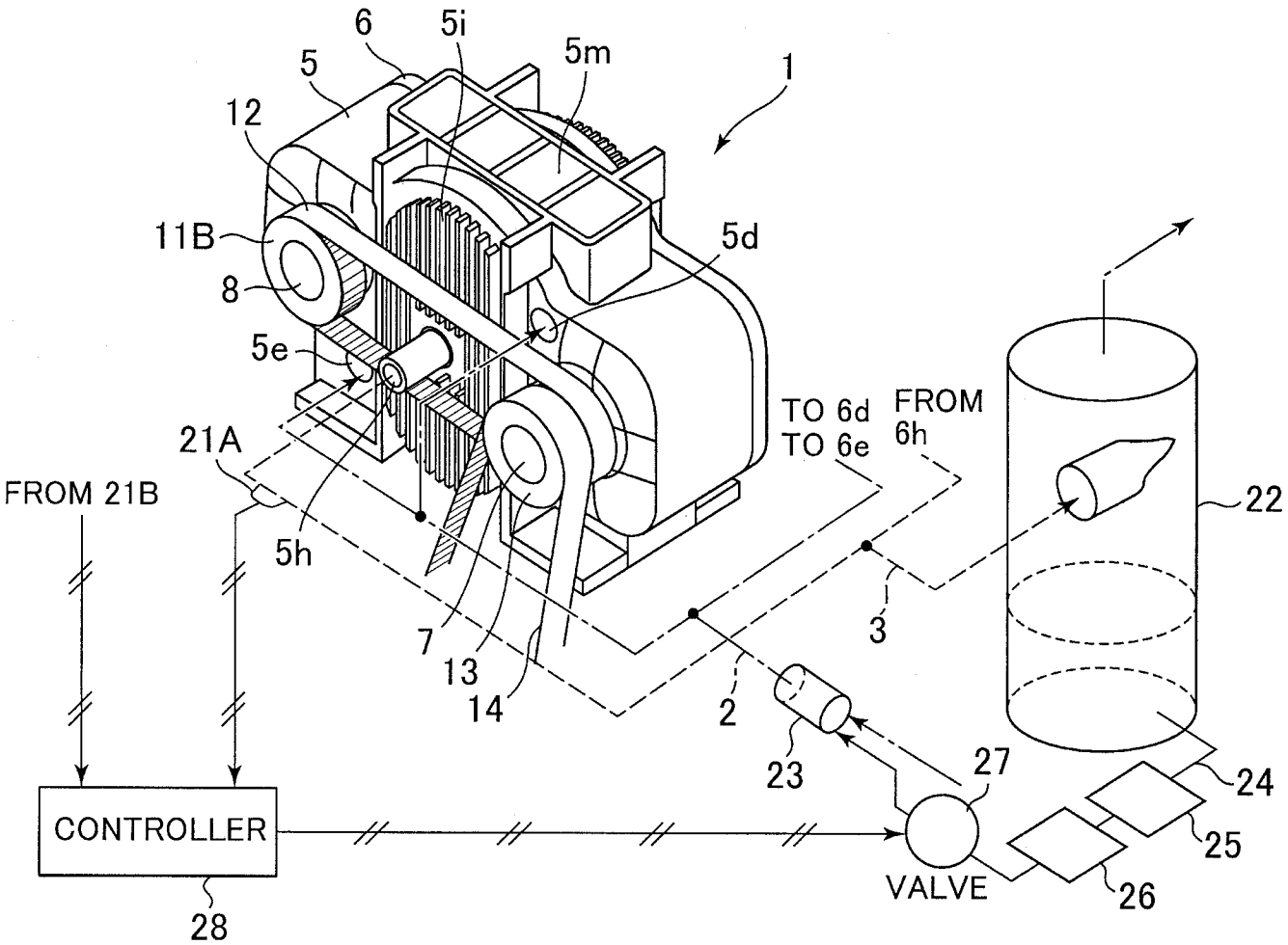
FIG. 1 is a configuration diagram of a water-injection type scroll air compressor in an embodiment of the present invention.
Figure 2:
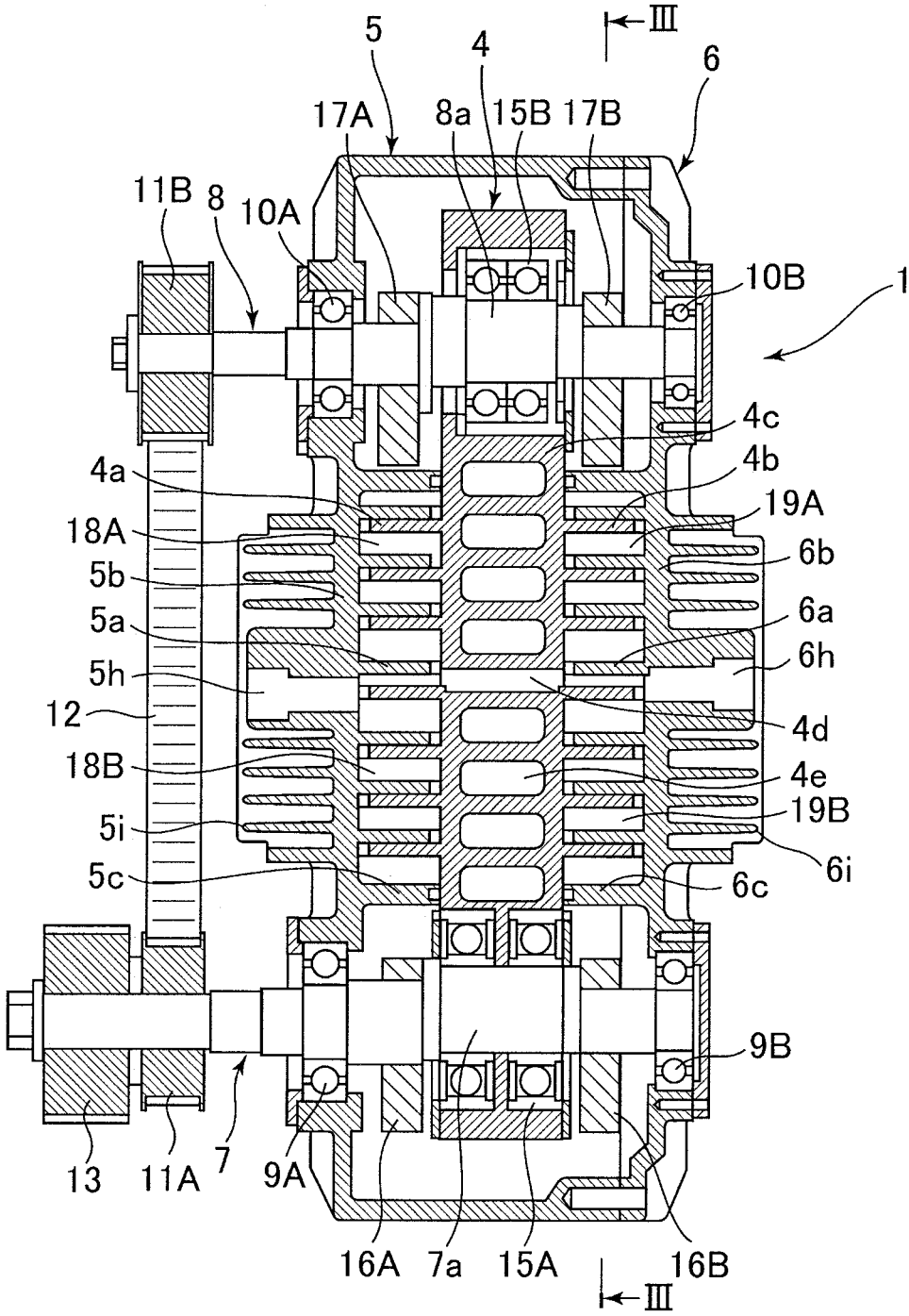
FIG. 2 is a plan sectional view that shows detailed construction of the compressor body in the embodiment of the present invention.
Figure 3:
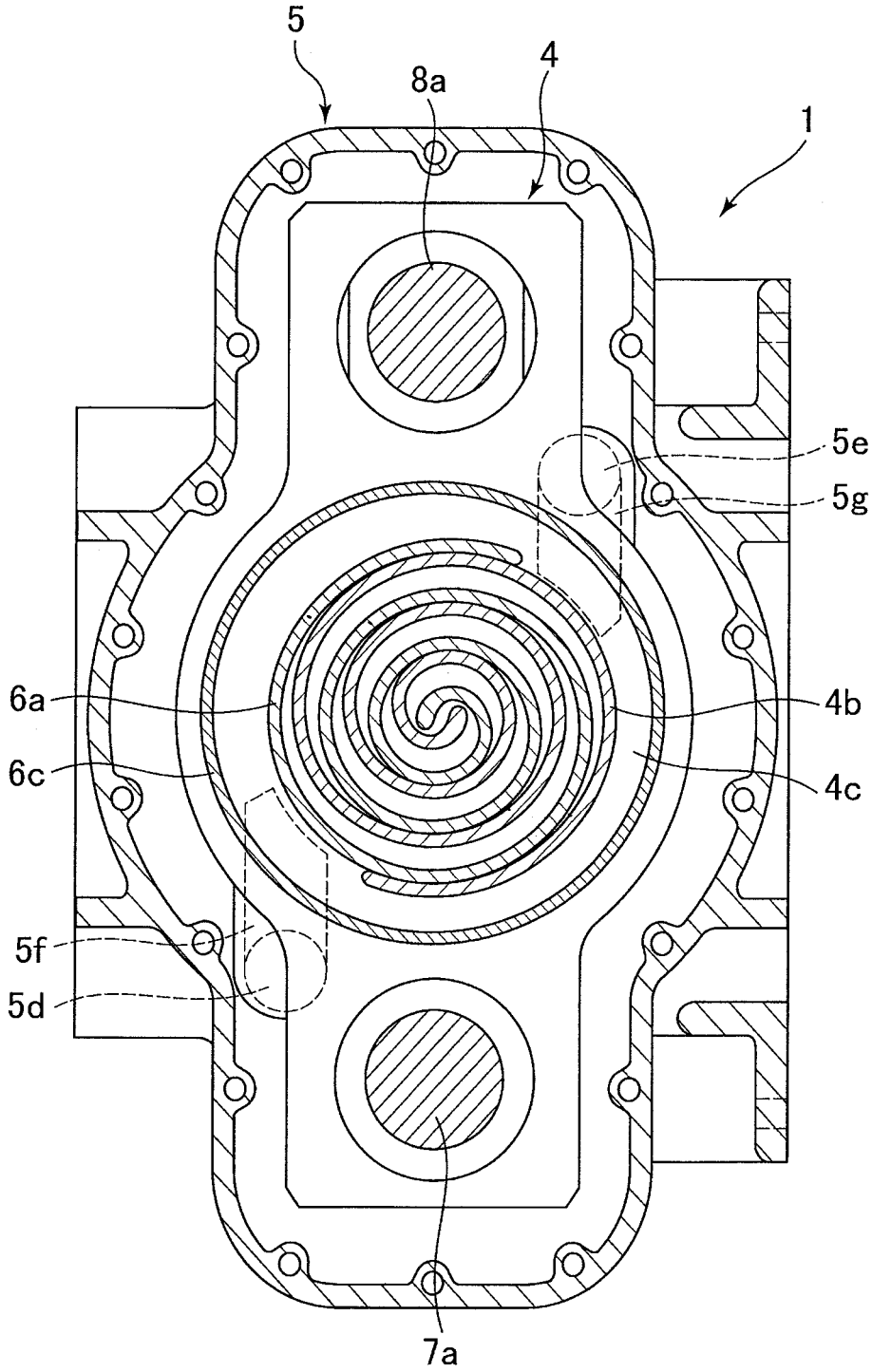
FIG. 3 is a side sectional view that shows the detailed construction of the compressor body in the embodiment of the present invention.
Figure 4:
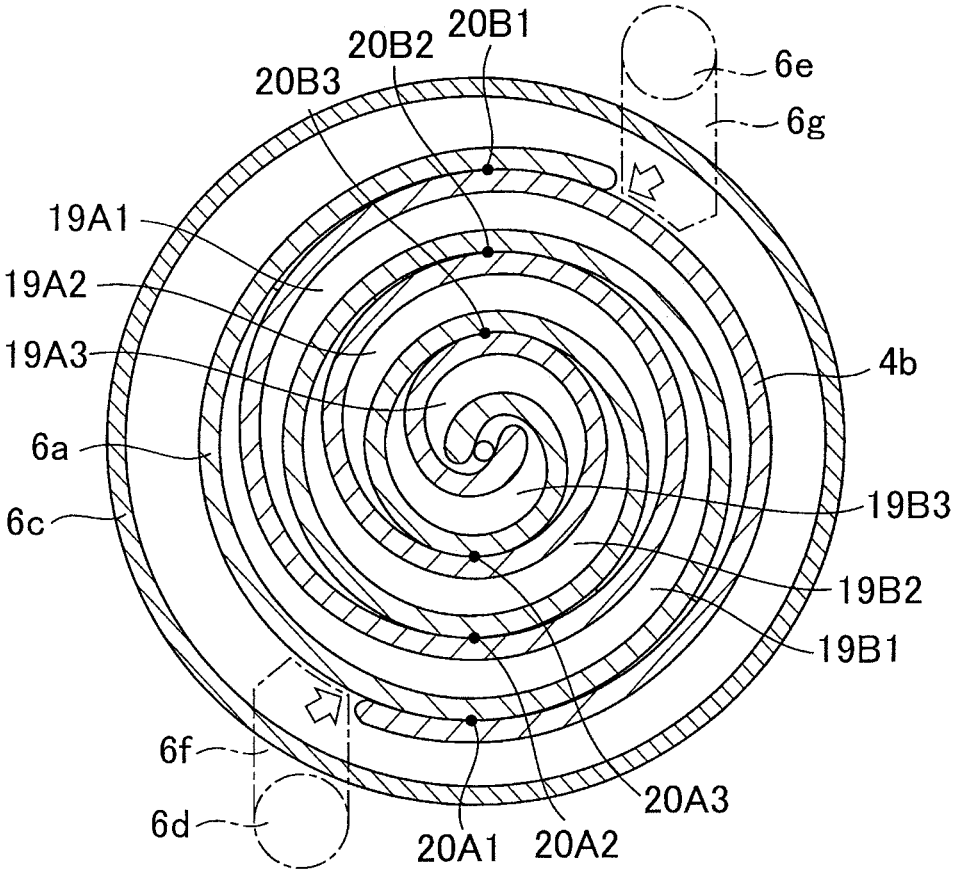
FIG. 4 is a partially enlarged view that shows compression chambers present inside the compressor body shown in FIG. 3.

FIG. 1 is a configuration diagram of a water-injection type scroll air compressor in an embodiment of the present invention, with the compressor body shown in perspective view and both an air line and a water line shown schematically. FIG. 2 is a plan sectional view that shows detailed construction of the compressor body in the embodiment of the present invention, and FIG. 3 is a side sectional view that shows the detailed construction of the compressor body. FIG. 4 is a partially enlarged view that shows compression chambers present inside the compressor body shown in FIG. 3.

The water-injection type scroll air compressor in FIGS. 1 to 4 includes the compressor body 1 that compresses air, an air suction pipeline 2 provided on a suction (intake) side of the compressor body 1, and an air discharge pipeline 3 provided on a discharge (exhaust) side of the compressor body 1.

The compressor body 1 includes: an orbiting scroll member 4 with nearly spiral wraps 4*a* and 4*b* formed on both sides (left and right sides in FIG. 2) of an end plate 4*c*; a fixed scroll member 5 with a nearly spiral wrap 5*a* formed on an internal lateral face (right side in FIG. 2) of an end plate 5*b* so as to mesh with the wrap 4*a* of the orbiting scroll member 4; a fixed scroll member 6 with a nearly spiral wrap 6*a* formed on an internal lateral face (left side in FIG. 2) of an end plate 6*b* so as to mesh with the wrap 4*b* of the orbiting scroll member 4; and a main crankshaft 7 and subsidiary crankshaft 8 used to make the orbiting scroll member 4 orbitally move with respect to the fixed scroll members 5 and 6.

The main crankshaft 7 is pivotally supported by bearings 9A and 9B provided on the fixed scroll members 5 and 6, respectively, and the subsidiary crankshaft 8 is pivotally supported by bearings 10A and 10B provided on the fixed scroll members 5 and 6, respectively. The main crankshaft 7 and the subsidiary crankshaft 8 each have an end portion protruding outward from the fixed scroll member 5 (i.e., to the left side in FIG. 2), and the end portions each have a toothed pulley 11A or 11B. A timing belt 12 is mounted between the pulleys 11A and 11B so that the main crankshaft 7 and the subsidiary crankshaft 8 rotate synchronously. A V-pulley 13 is also provided at the end of the main crankshaft 7, and between the V-pulley 13 and a V-pulley provided on a rotating shaft of a motor not shown is mounted a V-belt 14 (see FIG. 1), whereby rotationally motive power of the motor is transmitted to the main crankshaft 7.

The main crankshaft 7 has a crank 7*a* connected to an axial support on one side (lower side in FIG. 2) of the orbiting scroll member 4 via a bearing 15A, and the subsidiary crankshaft 8 has a crank 8*a* connected to an axial support on an opposite side (upper side in FIG. 2) of the orbiting scroll member 4 via a bearing 15B. The crank 7*a* of the main crankshaft 7 and the crank 8*a* of the subsidiary crankshaft 8 have the same amount of eccentricity with respect to an axial line, forming a parallel four-link structure. The orbiting scroll member 4 is thus axially supported so as to be orbitally movable. In order to compensate for an imbalance of the orbiting scroll member 4 due to the orbital movement thereof, balance weights 16A and 16B are fixedly arranged on the main crankshaft 7, and balance weights 17A and 17B are fixedly arranged on the subsidiary crankshaft 8.

The orbiting scroll member 4 includes: the wraps 4*a* and 4*b*; the end plate 4*c*; a communicating through-hole 4*d* formed centrally in a radial direction of the wraps 4*a* and 4*b* that are on the end plate 4*c*, in order to establish intercommunication between discharging compression chambers (detailed later herein) on both sides of the end plate; and a plurality of cooling air channels 4*e* formed to penetrate the end plate 4*c* near-vertically (perpendicularly to the paper of FIG. 2).

The fixed scroll member 5 includes: the wrap 5*a*; the end plate 5*b*; a dust wrap 5*c* of a nearly circular shape, formed near an outer peripheral edge of the wrap 5*a* on the end plate 5*b* in order to prevent entry of dust from the outside; suction ports 5*d* and 5*e* (see FIGS. 1 and 3) that are positioned on a radial outside of the dust wrap 5*c* on the end plate 5*b* and formed to be open on an outer lateral face of the end plate 5*b*; suction channels 5*f* and 5*g* (see FIG. 3) that are formed in the end plate 5*b* in order to establish intercommunication between the suction ports 5*d*, 5*e*, respectively, and a radial inside of the dust wrap 5*c*; a discharging port 5*h* formed centrally in a radial direction of the wrap 5*a* on the end plate 5*b*; and radiating fins 5*i* provided on the outer lateral face of the end plate 5*b*.

Similarly, the fixed scroll member 6 includes: the wrap 6*a*; the end plate 6*b*; a dust wrap 6*c* of a nearly circular shape, formed near an outer peripheral edge of the wrap 6*a* on the end plate 6*b* in order to prevent entry of dust from the outside; suction ports 6*d* and 6*e* (see FIG. 4) that are positioned on a radial outside of the dust wrap 6*c* on the end plate 6*b* and formed to be open on an outer lateral face of the end plate 6*b*; suction channels 6*f* and 6*g* (see FIG. 4) that are formed in the end plate 6*b* in order to establish intercommunication between the suction ports 6*d*, 6*e*, respectively, and a radial inside of the dust wrap 6*c*; a discharging port 6*h* formed centrally in a radial direction of the wrap 6*a* on the end plate 6*b*; and radiating fins 6*i* provided on the outer lateral face of the end plate 6*b*.

The fixed scroll members 5 and 6 are assembled in parallel and fastened to each other via bolts (not shown) or the like to constitute a housing that contains the orbiting scroll member 4. Cooling air vent holes 5*m* (see FIG. 1) are formed on an upper/lower surface of the housing (in further detail, the fixed scroll member 5), and cooling air from the vent holes 5*m* flows into and out from the housing (in further detail, the outer peripheral side of the dust wrap 5*c* within the fixed scroll member 5, that of the dust wrap 6*c* within the fixed scroll member 6, and the cooling air channels 4*e* in the orbiting scroll member 4). The housing interior and the orbiting scroll member 4 are thus cooled.

Compression routes 18A that take in air primarily from the suction port 5*d* and the suction channel 5*f*, then compress the air, and discharge the compressed air from the discharging port 5*h* is formed between the orbiting scroll member 4 and the fixed scroll member 5. More specifically, the wrap 4*a* on the orbiting scroll member 4 and the wrap 5*a* on the fixed scroll member 5 mesh with each other to form the compression routes 18A (compression chambers) on an inner peripheral side of the wrap 4*a*, and as the orbiting scroll member 4 orbitally moves, the compression chambers each move towards the discharging port 5*h* while reducing an internal volume. Compression routes 18B that take in air primarily from the suction port 5*e* and the suction channel 5*g*, then compress the air, and discharge the compressed air from the discharging port 5*h* is also formed between the orbiting scroll member 4 and the fixed scroll member 5. More specifically, the wrap 4*a* on the orbiting scroll member 4 and the wrap 5*a* on the fixed scroll member 5 mesh with each other to form the compression routes 18B (compression chambers) on an outer peripheral side of the wrap 4*a*, and as the orbiting scroll member 4 orbitally moves, the compression chambers each move towards the discharging port 5*h* while reducing an internal volume.

In addition, compression routes 19A that take in air primarily from the suction port 6*d* and the suction channel 6*f*, then compress the air, and discharge the compressed air from the discharging port 6*h* is formed between the orbiting scroll member 4 and the fixed scroll member 6. More specifically, as shown in, for example, FIG. 4, the wrap 4*b* on the orbiting scroll member 4 and the wrap 6*a* on the fixed scroll member 6 mesh with each other to form the compression routes 19A (compression chambers 19A1, 19A2, 19A3) on an inner peripheral side of the wrap 4*b*, and as the orbiting scroll member 6 orbitally moves, the compression chambers each move towards the discharging port 6*h* while reducing an internal volume. Furthermore, compression routes 19B that take in air primarily from the suction port 6*e* and the suction channel 6*g*, then compress the air, and discharge the compressed air from the discharging port 6*h* is formed between the orbiting scroll member 4 and the fixed scroll member 6. More specifically, as shown in, for example, FIG. 4, the wrap 4*b* on the orbiting scroll member 4 and the wrap 6*a* on the fixed scroll member 6 mesh with each other to form the compression routes 19B (compression chambers 19B1, 19B2, 19B3) on an outer peripheral side of the wrap 4*b*, and as the orbiting scroll member 4 orbitally moves, the compression chambers each move towards the discharging port 6*h* while reducing an internal volume.

The wrap 4*a* on the orbiting scroll member 4 and the wrap 5*a* on the fixed scroll member 5, or the wrap 4*b* on the orbiting scroll member 4 and the wrap 6*a* on the fixed scroll member 6 are constructed allowing for manufacturing errors (machining errors and assembly errors), thermal deformation, deformation under gas pressure, and other factors, so as not to come into contact with one another during operation or during stops. For this reason, a plurality of most confined portions (not shown) that become slight clearances are formed between the wraps 4*a* and 5*a* that form the plurality of compression chambers 18A and 18B. Likewise, as shown in, for example, FIG. 4, confined portions 20A1, 20A2 and 20A3 that become slight clearances are formed between the wraps 4*b* and 6*a* that form the plurality of compression chambers 19A1, 19A2 and 19A3, and confined portions 20B1, 20B2 and 20B3 that become slight clearances are formed between the wraps 4*b* and 6*a* that form the plurality of compression chambers 19B1, 19B2 and 19B3.

The discharging pipeline 3 has pipes each connected to the discharging port 5*h* or 6*h*, these pipes having thereon a temperature sensor 21A or 21B that detects a discharging temperature (only 21A is shown in FIG. 1). Additionally, the pipes connected to the discharging ports 5*h* and 6*h* are convergently connected together and then further connected to a water separator 22. The water separator 22 separates water contained in the compressed air that the compressor body 1 has discharged, and then supplies the air to a destination via a desiccator (not shown) or the like provided at a downstream end. The water separator 22 temporarily stores the separated water into a lower section of the separator.

The suction pipeline 2 is constructed to branch towards the suction ports 5*d*, 5*e* of the fixed scroll member 5 and the suction ports 6*d*, 6*e* of the fixed scroll member 6, and further branch into the suction ports 5*d*, 5*e* and 6*d*, 6*e*. A water feeder 23 is provided on an upstream side of the branching point at which the pipeline 2 is branched towards the suction ports 5*d*, 5*e* of the fixed scroll member 5 and the suction ports 6*d*, 6*e* of the fixed scroll member 6. A water supply line 24 is connected between a lower section of the water separator 22 and the water feeder 23.

The water supply line 24 includes a water cleaner 25 that removes undesirable substances contained in water, a water cooler 26 that cools down the water to a predetermined temperature level or less, and a control valve 27. The control valve 27 has its opening degree continuously controllable, and the opening degree is controlled according to a particular driving signal from a controller 28. For example, when the control valve 27 is opened, water is supplied from the water separator 22 via the water supply line 24 to the water feeder 23, at which the water is then injected into intake air. A flow rate of the water injected will therefore be controlled according to the particular opening degree of the control valve 27. One of major features of the present embodiment exists in a flow rate control range of the water injected.

Figure 5A:
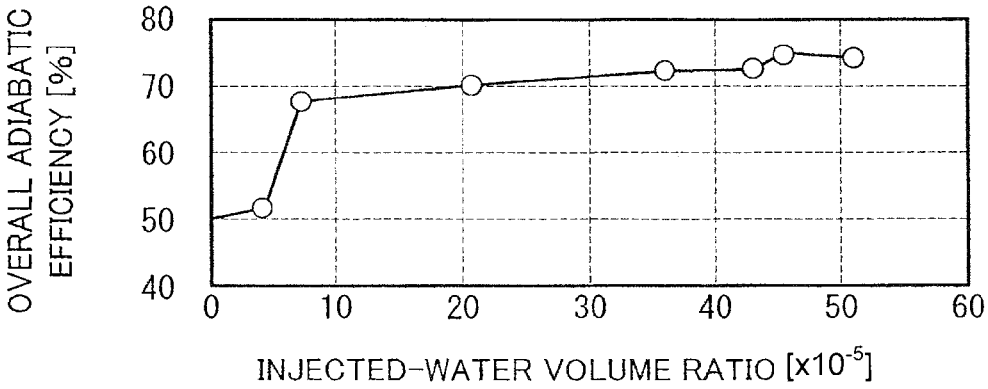
FIGS. 5A and 5B are characteristics diagrams that respectively represent a relationship between an injected-water volume ratio and overall adiabatic efficiency, and a relationship between the injected-water volume ratio and a discharging temperature, in the embodiment of the present invention.
Figure 5B:
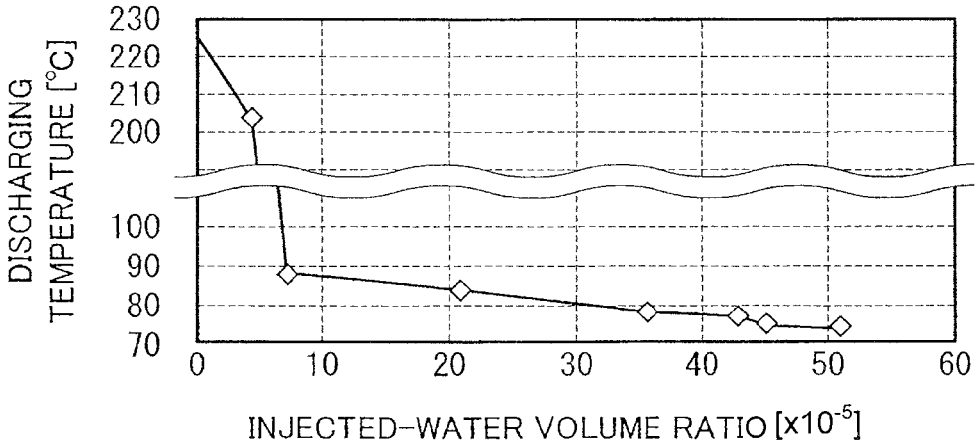

Experimental results that the present inventors obtained from the scroll air compressor of the above configuration are described below using FIGS. 5A and 5B. FIG. 5A is a characteristics diagram that represents a relationship between an injected-water volume ratio and overall adiabatic efficiency, and FIG. 5B is a characteristics diagram that represents a relationship between the injected-water volume ratio and a discharging temperature. The injected-water volume ratio here means a volume ratio between an intake air flow rate and injected-water flow rate in the water feeder 23 of the suction line 2. In the experiments employed, a compression ratio is 8 (in other words, a discharging pressure is 800 kPa), a compressor speed is 2,000 to 3,000 rpm, and clearances of the confined portions between the wraps 4*a* and 5*a* and between the wraps 4*b* and 6*a* are several tens of micrometers (μm). In addition, the experiments were conducted in the spring, the fall, and other thermally neutral seasons (in other words, at ordinary air temperature).

In the thermally neutral seasons, as shown in FIG. 5A, when the injected-water volume ratio is less than nearly $7\times10^{-5}$, as the injected-water volume ratio increases, the overall adiabatic efficiency of the compressor increases significantly, and a consequential increase rate of the overall adiabatic compressor efficiency per $1\times10^{-5}$ increase rate of the injected-water volume ratio reaches 2% or more of an original or initial value. In addition, when the injected-water volume ratio is nearly $7\times10^{-5}$, the overall adiabatic efficiency of the compressor is nearly 68%, and when the injected-water volume ratio is nearly $7\times10^{-5}$ or more, as the injected-water volume ratio increases, the overall adiabatic efficiency of the compressor increases insignificantly and a consequential increase rate of the overall adiabatic compressor efficiency per $1\times10^{-5}$ increase rate of the injected-water volume ratio decreases below 2% of the original or initial value. Furthermore, as shown in FIG. 5B: when the injected-water volume ratio is less than nearly $7\times10^{-5}$, as the injected-water volume ratio increases, the discharging temperature decreases significantly; when the injected-water volume ratio is nearly $7\times10^{-5}$, the discharging temperature is nearly 88° C.; and when the injected-water volume ratio is nearly $7\times10^{-5}$ or more, as the injected-water volume ratio increases, the discharging temperature decreases insignificantly. Furthermore, as shown in FIGS. 5A and 5B, when the injected-water volume ratio is nearly $10\times10^{-5}$, the overall adiabatic efficiency of the compressor is nearly 68.5% and the discharging temperature is nearly 87° C., and when the injected-water volume ratio is nearly $20\times10^{-5}$, the overall adiabatic efficiency of the compressor is nearly 70% and the discharging temperature is nearly 84.5° C.

It is also assumed that in the summertime and other hot seasons (in other words, at high air temperature), the injected-water volume ratio having the characteristics shown in FIGS. 5A and 5B shifts by nearly (1 to 2)$\times10^{-5}$ in a plus direction. More specifically, for example; at injected-water volume ratios less than nearly $9\times10^{-5}$, as the injected-water volume ratio increases, the overall adiabatic efficiency of the compressor increases significantly and a consequential increase rate of the overall compressor adiabatic efficiency per $1\times10^{-5}$ increase rate of the injected-water volume ratio reaches 2% or more; at injected-water volume ratios of nearly $9\times10^{-5}$, the overall adiabatic efficiency of the compressor is nearly 68%; and at injected-water volume ratios of at least nearly $9\times10^{-5}$, as the injected-water volume ratio increases, the overall adiabatic efficiency of the compressor increases insignificantly and a consequential increase rate of the overall compressor adiabatic efficiency per $1\times10^{-5}$ increase rate of the injected-water volume ratio is less than 2%. In addition, for example: at injected-water volume ratios less than nearly $9\times10^{-5}$, as the injected-water volume ratio increases, the discharging temperature decreases significantly; at injected-water volume ratios of nearly $9\times10^{-5}$, the discharging temperature reaches nearly 88° C.; and at injected-water volume ratios of at least nearly $9\times10^{-5}$, as the injected-water volume ratio increases, the discharging temperature decreases insignificantly. Furthermore, for example: at injected-water volume ratios of nearly $12\times10^{-5}$, the overall adiabatic efficiency of the compressor is nearly 68.5% and the discharging temperature is nearly 87° C.; and at injected-water volume ratios of nearly $22\times10^{-5}$, the overall adiabatic efficiency of the compressor is nearly 70% and the discharging temperature is nearly 84.5° C.

Moreover, it is assumed that in the wintertime and other cold seasons (in other words, at low air temperature), the injected-water volume ratio having the characteristics shown in FIGS. 5A and 5B shifts by nearly (1 to 2)$\times10^{-5}$ in a minus direction. More specifically, for example: at injected-water volume ratios less than nearly $5\times10^{-5}$, as the injected-water volume ratio increases, the overall adiabatic efficiency of the compressor increases significantly and a consequential increase rate of the overall compressor adiabatic efficiency per $1\times10^{-5}$ increase rate of the injected-water volume ratio reaches 2% or more; at injected-water volume ratios of nearly $5\times10^{-5}$, the overall adiabatic efficiency of the compressor is nearly 68%; and at injected-water volume ratios of at least nearly $5\times10^{-5}$, as the injected-water volume ratio increases, the overall adiabatic efficiency of the compressor increases insignificantly and a consequential increase rate of the overall compressor adiabatic efficiency per $1\times10^{-5}$ increase rate of the injected-water volume ratio is less than 2%. Besides, for example: at injected-water volume ratios less than nearly $5\times10^{-5}$, as the injected-water volume ratio increases, the discharging temperature decreases significantly; at injected-water volume ratios of nearly $5\times10^{-5}$, the discharging temperature reaches nearly 88° C.; and at injected-water volume ratios of at least nearly $5\times10^{-5}$, as the injected-water volume ratio increases, the discharging temperature decreases insignificantly. Furthermore, for example: at injected-water volume ratios of nearly $8\times10^{-5}$, the overall adiabatic efficiency of the compressor is nearly 68.5% and the discharging temperature is nearly 87° C.; and at injected-water volume ratios of nearly $18\times10^{-5}$, the overall adiabatic efficiency of the compressor is nearly 70% and the discharging temperature is nearly 84.5° C.

In this way, in hot and cold seasons (in other words, under an influence of the air temperature, relative humidity, atmospheric pressure, and/or the like), the characteristics shown in FIGS. 5A and 5B shift slightly. These characteristics also slightly shift under an influence of the compression ratio, compressor speed, clearances of the confined portions, and/or the like. Accordingly, it is preferable that allowing for changes in the above parameters and on the basis of the characteristics shown in FIG. 5A, the control range of the injected-water flow rate should be set to stay in an injected-water volume ratio range of $5\times10^{-5}$ to $40\times10^{-5}$, and at the same time, in an injected-water volume ratio range of the compressor characterized so that an increase rate of the overall compressor adiabatic efficiency per $1\times10^{-5}$ increase rate of the injected-water volume ratio stays less than 2% of an original or initial value. Presetting the control range of the injected-water flow rate in this manner and then controlling the opening degree of the control valve 27 to be variable allows the overall adiabatic efficiency of the compressor to be increased above nearly 68%, despite the relatively small injected-water flow rate, and the pre-stopping operation time for drying to be reduced because of the relatively small injected-water flow rate.

In the present embodiment, the control range of the injected-water flow rate can be set indirectly by presetting a target range for the discharging temperature. For example, an upper-limit value of nearly 87° C. and a lower-limit value of nearly 84.5° C. are prestored in a preset condition as the target range of the discharging temperature, in an internal memory (storage element) of the controller 28. The opening degree of the control valve 27 is controlled so that the discharging temperature detected by the temperature sensor 21A (or the discharging temperature detected by the temperature sensor 21B, or an average value of the discharging temperatures detected by the temperature sensors 21A, 21B) will stay within the target range of 84.5° C. to 87° C. That is to say, when the detected discharging temperature exceeds nearly 87° C., the opening degree of the control valve 27 will be increased, or when the detected discharging temperature is less than 84.5° C., the opening degree of the control valve 27 will be reduced.

Thus, the control range of the injected-water volume ratio can be varied automatically to obtain an overall compressor adiabatic efficiency of nearly 68.5% to 70%, regardless of whether a particular season is thermally neutral, hot, or cold. More specifically, the control range of the injected-water volume ratio takes: in thermally neutral seasons, a minimum value of nearly $10\times10^{-5}$ and a maximum value of nearly $20\times10^{-5}$; in hot seasons, a minimum value of nearly $12\times10^{-5}$ and a maximum value of nearly $22\times10^{-5}$; and in cold seasons, a minimum value of nearly $8\times10^{-5}$ and a maximum value of nearly $18\times10^{-5}$.

An example in which the control valve 27 whose opening degree can be continuously changed is provided on the water supply line 24 and the opening degree of the control valve 27 is controlled by the controller 28 has been taken in the description of the above embodiment, but the example does not limit the present invention. That is to say, the control valve 27 may be replaced by a plurality of control valves each switchable to a fully open state or a fully closed state (preferably, these control valves may differ from one another in opening degree when fully open), and the number of opening/closing operations of each control valve may be controlled by the controller. Even more minutely, for example, when the detected discharging temperature exceeds the upper-limit value of the target range, the controller reduces the number of closed control valves by increasing that of open control valves, and when the detected discharging temperature is less than the lower-limit value of the target range, the controller increases the number of closed control valves by reducing that of open control valves. Substantially the same advantageous effects as those achievable in the embodiment can be obtained, even in such a modification.

An example in which the suction line 2 includes the water feeder 23 on the upstream side of the branching point at which the pipeline is branched into the suction ports 5*d*, 5*e* of the fixed scroll member 5 and the suction ports 6*d*, 6*e* of the fixed scroll member 6, and also includes the water supply line 24 that supplies water to the water feeder 23 (in other words, one water-injection place is present on the suction line 2), has also been taken in the description of the above embodiment, but the example does not limit the present invention and a plurality of water-injection places may be present. That is to say, for example, on a downstream side of the branching point at which the pipeline is branched into the suction ports 5*d*, 5*e* of the fixed scroll member 5 and the suction ports 6*d*, 6*e* of the fixed scroll member 6, water feeders may be provided in a plurality of places and also water supply lines may be provided to supply water to the plurality of water feeders. Alternatively, water supply lines may be provided that directly injects water into each of the compression routes 18A, 18B, 19A and 19B, within the compressor body. In these modifications, an integrated flow rate of the water injected at the plurality of water injection places, for example, may be controlled by a control valve. Otherwise, injected-water flow rates at the plurality of water injection places may each be controlled by an independent control valve according to the discharging temperature detected by the relevant temperature sensor (more specifically, for the compression routes 18A, 18B, the discharging temperature detected by the temperature sensor 21A, or for the compression routes 19A, 19B, the discharging temperature detected by the temperature sensor 21B). Substantially the same advantageous effects as those achievable in the embodiment can be obtained, even in such a case.

In addition, an example in which the controller 28 conducts driving control of the control valve 27 so that the detected discharging temperature stays within the preset and prestored target range has been taken in the description of the above embodiment, but the example does not limit the present invention. That is to say, for example, the controller 28 may conduct driving control of the control valve 27 so that the injected-water volume ratio stays within the preset and prestored control range. In this case, the injected-water volume ratio will be set to stay within a range of $5\times10^{-5}$ to $40\times10^{-5}$ and at the same time, to stay within the characteristics range in which an increase rate of the overall compressor adiabatic efficiency per $1\times10^{-5}$ increase rate of the injected-water volume ratio stays less than 2%. In a more specific example, the control range of the injected-water volume ratio may be changed according to the particular season (thermally neutral, hot, or cold). Alternatively, the injected-water volume ratio control range adopted in thermally neutral seasons may be, for example, between a minimum value of nearly (7 to 12)$\times10^{-5}$ and a maximum value of nearly (18 to 38)$\times10^{-5}$, the injected-water volume ratio control range adopted in hot seasons may be, for example, between a minimum value of nearly (9 to 14)$\times10^{-5}$ and a maximum value of nearly (20 to 40)$\times10^{-5}$, and the injected-water volume ratio control range adopted in cold seasons may be, for example, between a minimum value of nearly (5 to 10)$\times10^{-5}$ and a maximum value of nearly (16 to 36)$\times10^{-5}$. In yet another specific example, irrespective of whether the season is thermally neutral, hot, or cold, the control range of the injected-water volume ratio may be fixed and take a minimum value of nearly $10\times10^{-5}$ and a maximum value of nearly $20\times10^{-5}$. Substantially the same advantageous effects as those achievable in the embodiment can be obtained, even in such a case.

The water-injection type scroll air compressor in which an orbiting scroll member with nearly spiral wraps formed on both sides thereof is mechanically oscillated with respect to one pair of fixed scroll members formed with nearly spiral wraps corresponding to the wraps of the orbiting scroll member has been taken as an example in the above description. This example, however, does not limit the present invention. That is to say, it goes without saying that the invention may also be applied to a water-injection type scroll air compressor constructed so that an orbiting scroll member with a nearly spiral wrap formed only on one side thereof is mechanically oscillated with respect to a fixed scroll member formed with a nearly spiral wrap corresponding to the wrap of the orbiting scroll member.

What is claimed is:

1. A water-injection type scroll air compressor, comprising:

a compressor body configured to compress air by mechanically oscillating an orbiting scroll member formed with a nearly spiral wrap thereon, with respect to a fixed scroll member formed with a nearly spiral wrap thereon to mate with the wrap of the orbiting scroll member; and a water supply line configured to inject water into a suction side or compression chambers of the compressor body, wherein the water supply line conducts the injection in a range of an injected-water ratio expressed as a ratio of an injected-water flow rate to an intake air flow rate, the range including values greater than about $5\times10^{-5}$ and less than about $40\times10^{-5}$, and characterized so that an increase rate of overall adiabatic efficiency of the compressor per $1\times10^{-5}$ increase in rate of the injected-water ratio stays less than 2% of an original or initial value.

2. A water-injection type scroll air compressor, comprising:

a compressor body configured to compress air by mechanically oscillating an orbiting scroll member formed with nearly spiral wraps on both sides thereof, with respect to one pair of fixed scroll members formed with nearly spiral wraps thereon to mate with the wraps of the orbiting scroll member, and a water supply line configured to inject water into a suction side or compression chambers of the compressor body, wherein the water supply line conducts the injection in a range of an injected-water ratio expressed as a ratio of an injected-water flow rate to an intake air flow rate, the range including values greater than about $5\times10^{-5}$ and less than about $40\times10^{-5}$, and characterized so that an increase rate of overall adiabatic efficiency of the compressor per $1\times10^{-5}$ increase in rate of the injected-water ratio stays less than 2% of an original or initial value.

3. The water-injection type scroll air compressor according to claim 1, further comprising:

a control valve provided on the water supply line, the control valve being configured to control the flow rate of the water injected into the suction side or compression chambers of the compressor body;

a temperature sensor configured to detect a discharging temperature of the compressor body;

a storage element of a target range of the discharging temperature, the target range being preset such that the injected-water ratio is maintained in a range, the range including values greater than about $5\times10^{-5}$ and less than about $40\times10^{-5}$, and characterized so that the increase rate of the overall compressor adiabatic efficiency per $1\times10^{-5}$ increase in rate of the injected-water ratio stays less than 2% of the original or initial value; and a controller configured to conduct driving control of the control valve so that the discharging temperature detected by the temperature sensor will fall within the preset range.

4. The water-injection type scroll air compressor according to claim 3, wherein the controller is adopted to increase an opening degree of the control valve when the temperature sensor detects a discharging temperature exceeding an upper-limit value of the discharging temperature target range prestored in the storage element, and to reduce the opening degree of the control valve when the temperature sensor detects a discharging temperature less than a lower-limit value of the discharging temperature target range prestored in the storage element.

5. The water-injection type scroll air compressor according to claim 2, further comprising:

a control valve provided on the water supply line, the control valve being configured to control the flow rate of the water injected into the suction side or compression chambers of the compressor body;

a temperature sensor configured to detect a discharging temperature of the compressor body;

a storage element of a target range of the discharging temperature, the target range being preset such that the injected-water ratio is maintained in a range, the range being within the about $5\times10^{-5}$ to about $40\times10^{-5}$ range and characterized so that the increase rate of the overall compressor adiabatic efficiency per $1\times10^{-5}$ increase in rate of the injected-water ratio stays less than 2% of the original or initial value; and a controller configured to conduct driving control of the control valve so that the discharging temperature detected by the temperature sensor will fall within the preset range.

6. The water-injection type scroll air compressor according to claim 5, wherein the controller is adopted to increase an opening degree of the control valve when the temperature sensor detects a discharging temperature exceeding an upper-limit value of the discharging temperature target range prestored in the storage element, and to reduce the opening degree of the control valve when the temperature sensor detects a discharging temperature less than a lower-limit value of the discharging temperature target range prestored in the storage element.

7. The water-injection type scroll air compressor according to claim 1, wherein in the thermally neutral seasons of fall and spring, the range of the injected-water volume ratio includes values greater than about $7\times10^{-5}$ and less than about $40\times10^{-5}$;

wherein in the summer, the range of the injected-water volume ratio includes values greater than about $9\times10^{-5}$ and less than about $40\times10^{-5}$; and wherein in the winter, the range of the injected-water volume ratio includes values greater than about $5\times10^{-5}$ and less than about $40\times10^{-5}$.

8. The water-injection type scroll air compressor according to claim 2, wherein in the thermally neutral seasons of fall and spring, the range of the injected-water volume ratio includes values greater than about $7\times10^{-5}$ and less than about $40\times10^{-5}$;

wherein in the summer, the range of the injected-water volume ratio includes values greater than about $9\times10^{-5}$ and less than about $40\times10^{-5}$; and wherein in the winter, the range of the injected-water volume ratio includes values greater than about $5\times10^{-5}$ and less than about $40\times10^{-5}$.

9. The water-injection type scroll air compressor according to claim 3, wherein in the thermally neutral seasons of fall and spring, the range of the injected-water volume ratio includes values greater than about $7\times10^{-5}$ and less than about $40\times10^{-5}$;

wherein in the summer, the range of the injected-water volume ratio includes values greater than about $9\times10^{-5}$ and less than about $40\times10^{-5}$; and wherein in the winter, the range of the injected-water volume ratio includes values greater than about $5\times10^{-5}$ and less than about $40\times10^{-5}$.

10. The water-injection type scroll air compressor according to claim 4, wherein in the thermally neutral seasons of fall and spring, the range of the injected-water volume ratio includes values greater than about $7\times10^{-5}$ and less than about $40\times10^{-5}$;

wherein in the summer, the range of the injected-water volume ratio includes values greater than about $9\times10^{-5}$ and less than about $40\times10^{-5}$; and wherein in the winter, the range of the injected-water volume ratio includes values greater than about $5\times10^{-5}$ and less than about $40\times10^{-5}$.

11. The water-injection type scroll air compressor according to claim 5, wherein in the thermally neutral seasons of fall and spring, the range of the injected-water volume ratio includes values greater than about $7\times10^{-5}$ and less than about $40\times10^{-5}$;

wherein in the summer, the range of the injected-water volume ratio includes values greater than about $9\times10^{-5}$ and less than about $40\times10^{-5}$; and wherein in the winter, the range of the injected-water volume ratio includes values greater than about $5\times10^{-5}$ and less than about $40\times10^{-5}$.

12. The water-injection type scroll air compressor according to claim 6, wherein in the thermally neutral seasons of fall and spring, the range of the injected-water volume ratio includes values greater than about $7\times10^{-5}$ and less than about $40\times10^{-5}$;

wherein in the summer, the range of the injected-water volume ratio includes values greater than about $9\times10^{-5}$ and less than about $40\times10^{-5}$; and wherein in the winter, the range of the injected-water volume ratio includes values greater than about $5\times10^{-5}$ and less than about $40\times10^{-5}$.

* * * * *